US006591749B2

(12) United States Patent
Elkis et al.

(10) Patent No.: US 6,591,749 B2
(45) Date of Patent: Jul. 15, 2003

(54) PRINTING MACHINE WITH IMPROVED VACUUM TRANSFER

(75) Inventors: Michael Elkis, Columbia, MD (US); Mark R. Donovan, Severn, MD (US)

(73) Assignee: Ward, Inc., Jefferson City, MO (US)

( * ) Notice: Subject to any disclaimer, the term of this patent is extended or adjusted under 35 U.S.C. 154(b) by 133 days.

(21) Appl. No.: 09/938,340

(22) Filed: Aug. 24, 2001

(65) Prior Publication Data

US 2002/0053293 A1 May 9, 2002

Related U.S. Application Data

(63) Continuation-in-part of application No. 09/708,156, filed on Nov. 8, 2000.

(51) Int. Cl.[7] ..... B41F 13/24

(52) U.S. Cl. ..... 101/232; 101/233; 101/424.1; 271/276; 271/197; 198/689.1

(58) Field of Search ..... 101/132, 232, 101/233, 216, 183, 424.1; 271/276, 194, 196, 197, 45, 3, 3.23; 198/689.1; 34/659, 663; 400/635

(56) References Cited

U.S. PATENT DOCUMENTS

| | | | | | |
|---|---|---|---|---|---|
| 1,669,066 | A | * | 5/1928 | Murck | 34/663 |
| 2,384,155 | A | * | 9/1945 | Brunk | 34/663 |
| 3,477,558 | A | * | 11/1969 | Fleischauer | 271/197 |
| 3,902,407 | A | * | 9/1975 | Trosdorff | 271/45 |
| 3,904,188 | A | * | 9/1975 | Fairbanks et al. | 271/276 |
| 4,526,360 | A | * | 7/1985 | Focke | 271/197 |
| 4,572,071 | A | * | 2/1986 | Cappel et al. | 101/183 |
| 4,745,432 | A | * | 5/1988 | Langdon | 271/197 |
| 4,831,419 | A | * | 5/1989 | Iaia, Jr. et al. | 271/197 |
| 5,004,221 | A | * | 4/1991 | Stark | 271/194 |
| 5,156,257 | A | * | 10/1992 | Hundebol | 198/689.1 |
| 5,163,891 | A | * | 11/1992 | Goldsborough et al. | 493/321 |
| 5,183,251 | A | * | 2/1993 | Sardella | 271/276 |
| 5,383,392 | A | * | 1/1995 | Kowalewski et al. | 101/183 |
| 5,445,369 | A | * | 8/1995 | Golicz et al. | 271/3.23 |
| 5,467,180 | A | * | 11/1995 | Malachowski et al. | 271/276 |
| 5,509,352 | A | * | 4/1996 | Kowalewski et al. | 101/232 |
| 5,564,693 | A | | 10/1996 | Elkis et al. | 271/276 |
| 5,782,183 | A | | 7/1998 | Andrews | 101/232 |

* cited by examiner

*Primary Examiner*—Eugene H. Eickholt
(74) *Attorney, Agent, or Firm*—Bartlett & Sherer; Ronald B. Sherer

(57) ABSTRACT

A multistage printing machine is disclosed with a vacuum conveyor between stages, and in which supplemental air is provided adjacent at least one printing cylinder.

9 Claims, 4 Drawing Sheets

PRINTING MACHINE WITH IMPROVED VACUUM TRANSFER

RELATED APPLICATION

This Application is a Continuation-In-Part of application Ser. No. 09/708,156 filed Nov. 8, 2000 which is hereby incorporated by reference.

FIELD

This Application relates to rotary printing machines, and more particularly, to printing machines which transport individual sheets of material to be imprinted from one stage of the machine to another by vacuum transfer systems, and in which dust contamination of the printing plates is a serious problem.

BACKGROUND

As disclosed, for example, in parent application Ser. No. 09/708,156, and in U.S. Pat. No. 5,564,693 incorporated by reference herein, it is known to transport individual sheets of material, such as corrugated cardboard, from one stage of printing machines to the next by means of transfer systems employing conveyor belts and/or rollers. In order to maintain the sheets in firm contact with the belts and/or rollers it is known to create a pressure differential above and below the plane of travel of the sheets which is known as the "board line". While maximum pressure differentials across the board line have been desired, maximum differential pressures have been limited by unacceptable levels of energy consumption in the motor-driven blowers. Also, maximum differential pressures have been limited by unacceptable levels of dust and other foreign particles, hereinafter "dust", being drawn into the housing of the printing machine where they may foul the printing plates and create other serious operating problems. While dust is a significant problem in all printing machines, it is a major problem in printing machines which include die cutter sections in which the printed material is cut and scored such that large amounts of dust are created in the machine.

SUMMARY

The present invention enables highly efficient pressure differentials to be created with low power levels, and with minimized dust flow adjacent the printing cylinders, by the controlled supply of supplemental air at negative pressure and at specific locations in the vacuum transfer system.

DETAILED DESCRIPTION

Figure 1:
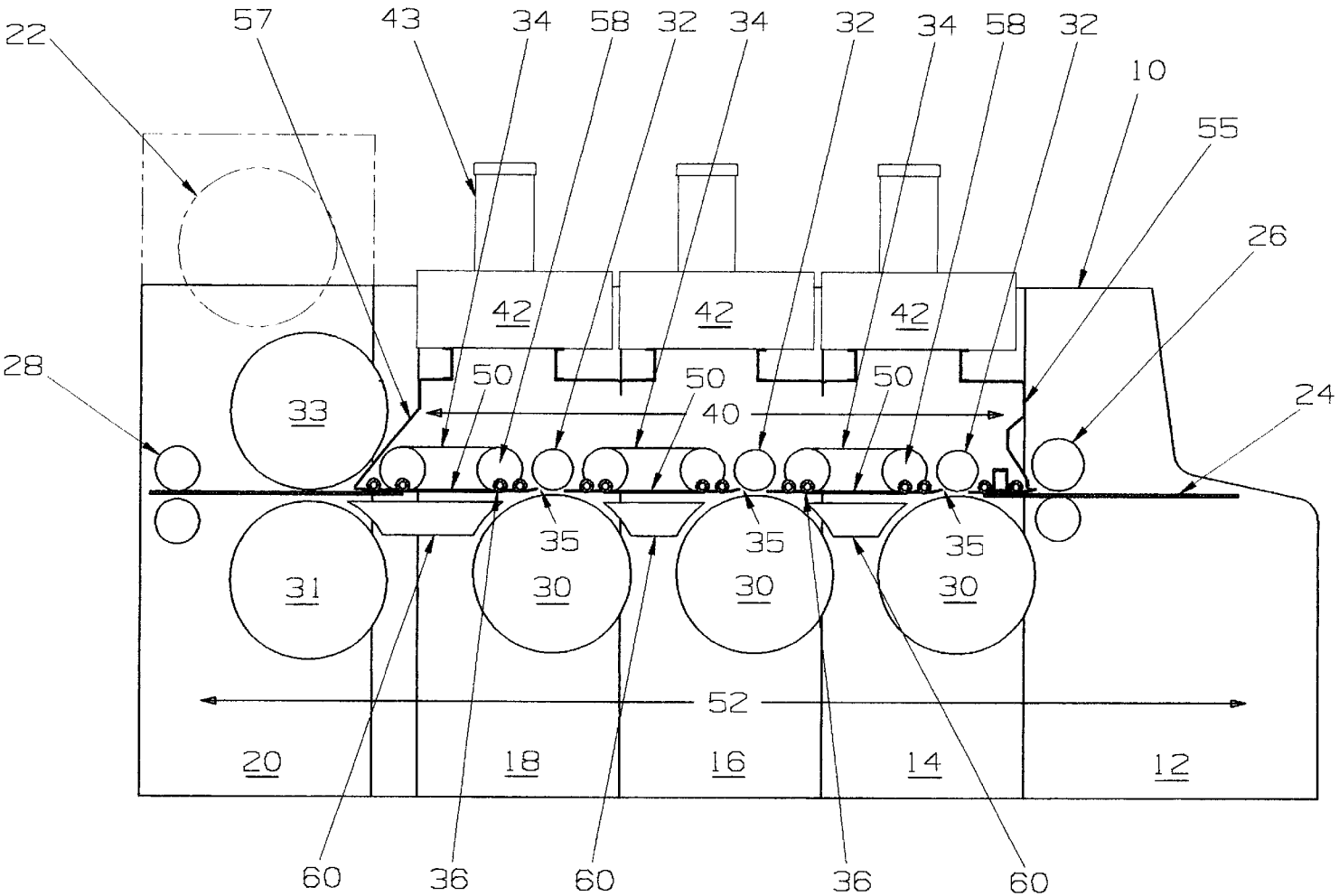
FIG. 1 is a schematic side elevational view of one preferred embodiment of the present invention.
Figure 2:
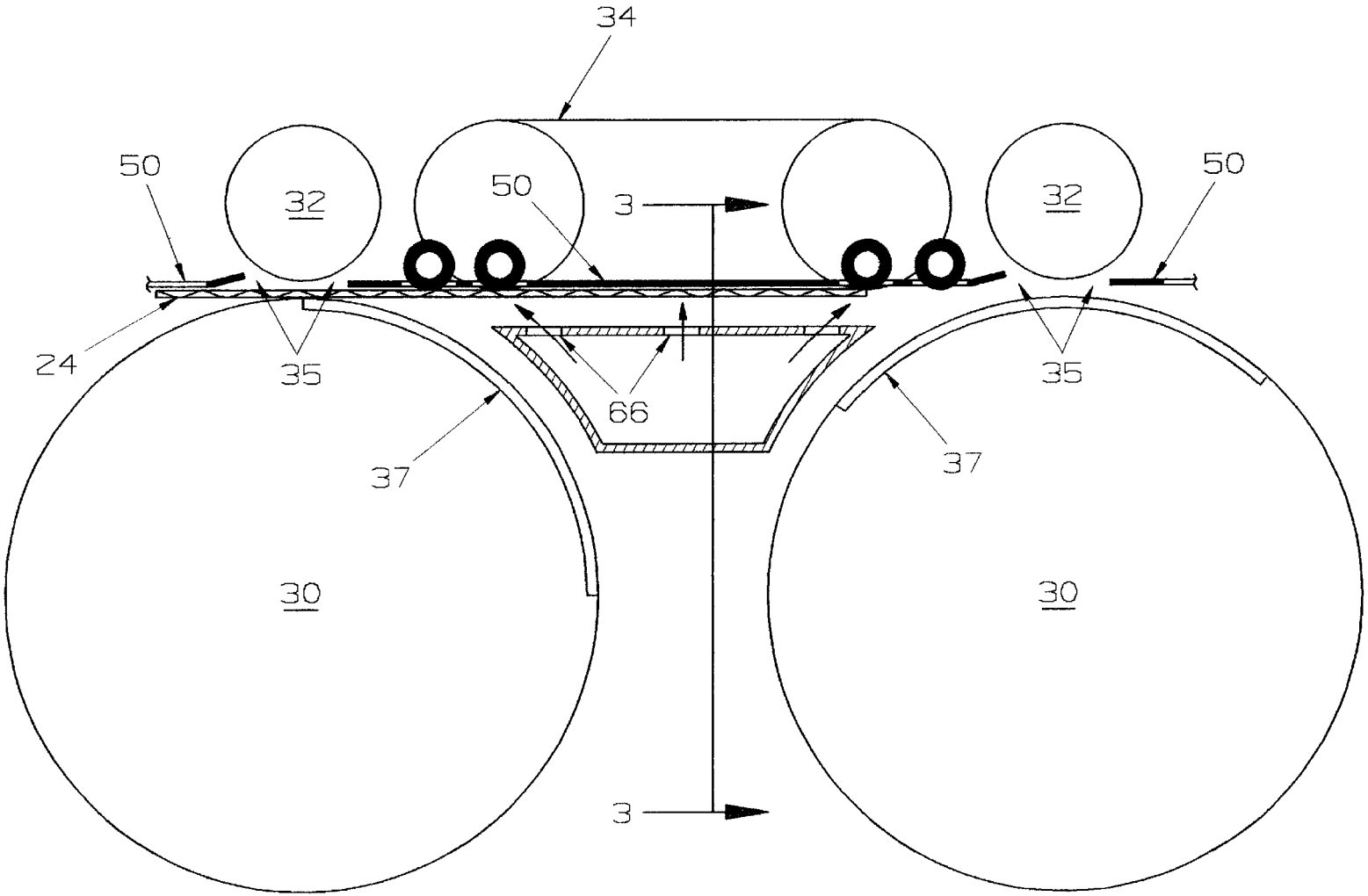
FIG. 2 is an enlarged side view of two stages of the printing machine with one preferred design of plenum chamber.

Referring to FIGS. 1 and 2, an example of a flexographic printing machine 10 is shown as comprising a feed or inlet stage 12, three stages of printing 14, 16 and 18, a die cutter stage 20 and an optional pin stripper 22. Of course, it will be readily understood to those skilled in the art that the number of printing stages may vary from one machine to another, and that additional stages may be added, such as a folder-gluing stage, or the printing machine may comprise only one or more printing stages depending upon the needs of the customer. For purposes of schematic illustration, "boards" or sheets 24 of material to be imprinted are illustrated as passing through the printing machine from feed rollers 26 to discharge rollers 28 through the plane of the board line. In the illustrated embodiment, sheets 24 may be composed of corrugated cardboard, hereinafter "corrugated" as known in the industry, such as to form containers or displays after multi-color printing of very high resolution.

As is conventional, each printing stage includes a print cylinder 30 carrying a print plate 37 and an impression cylinder 32 between which the sheets pass while being imprinted with a different color of printing. Conveyor belts 34 convey each sheet to the next stage, and may or may not include rollers or supports 36. In the illustrated embodiment, an "extended" or "continuous" partial vacuum is created in an elongated and unitary chamber 40 above horizontally extending plates 50. The plates are positioned slightly above the board line, thus creating slots 35 for air flow around the print and impression cylinders, and the horizontal ends of extended chamber 40 are sealed by end closures 55 and 57. While elongated chamber 40 is illustrated as being without partitions or dividers for each fan zone, the present invention is equally applicable to machines with such partitions or divided fan zones.

A plurality of blowers 42 driven by motors 43 are provided to exhaust air from the chamber 40 thereby producing a substantially uniform partial vacuum in extended chamber 40 above plates 50. Since a greater pressure exists below the plates in chamber 52, sheets 24 are forcefully urged upwardly and pressed against the lower reaches of belts 34 in firm frictional contact with the belts. As a result, the sheets are transported from stage to stage without slippage or becoming skewed. However, it has been found that without the present invention, and whether chamber 40 is a non-partitioned chamber as illustrated or whether it is divided by partitions into blower zones, the pressure within the machine below the board line is not truly at atmospheric pressure. Rather, it is at a small but significant negative pressure; i.e., a slightly subatmospheric pressure. It has also been discovered that increasing the pressure above the board line to a lesser negative pressure does not cause the pressure in the machine below the board line to become equal to atmospheric pressure. While the amount of this negative or subatmospheric pressure in the machine below plates 50 is quite small, it has been discovered to be sufficient to draw undesirable quantities of dust into the machine. That is, air from the die cutter section and/or other dusty ambient air is drawn into the machine.

The present invention solves this dilemma by flowing supplemental air at a negative pressure into the machine below the board line at one or more locations. As illustrated by way of example in FIGS. 1–3, one or more plenum chambers 60 are positioned so as to extend across the width of the interior of the machine below the board line. Supplemental air is supplied by passing ambient air through filters 62 into plenums 60, and the supplemental air is discharged through apertures 66 as shown in FIG. 2. Since the printing plates are the component of the machine which are most sensitive to dust, the plenums and outlets 66 are positioned so as to supply the supplemental air immediately adjacent to the printing cylinders as shown in FIGS. 1 and 2. For this reason, the sides of the plenums are preferably curved with a curvature approximately that of the printing cylinders as shown in FIGS. 1 and 2. This allows the plenum to be as close as possible to the cylinder to restrict the air flow there between.

In the foregoing description it will be noted that the supplemental air is not forced into the machine at super atmospheric pressure by any fan or blower injecting the air into the machine under positive pressure. Rather, it has been discovered that forced air injection aggravates the dust problem with the printing plates. Instead, it has been discovered that the problem of dust on the plates is solved by allowing the supplemental air to flow into the machine and around the printing plates by the negative pressure created by the exhaust blowers 42. In other words, the supplemental air enters the machine at a negative pressure; i.e., less than atmospheric pressure, rather than at a positive or superatmostpheric pressure. In this manner, clean and substantially dust-free supplemental air is supplied to the area of the print cylinders and plates not withstanding that other ambient air, not filtered, may enter the machine from the essentially open bottom as is conventional and illustrated by the arrows in FIG. 3.

Figure 3:
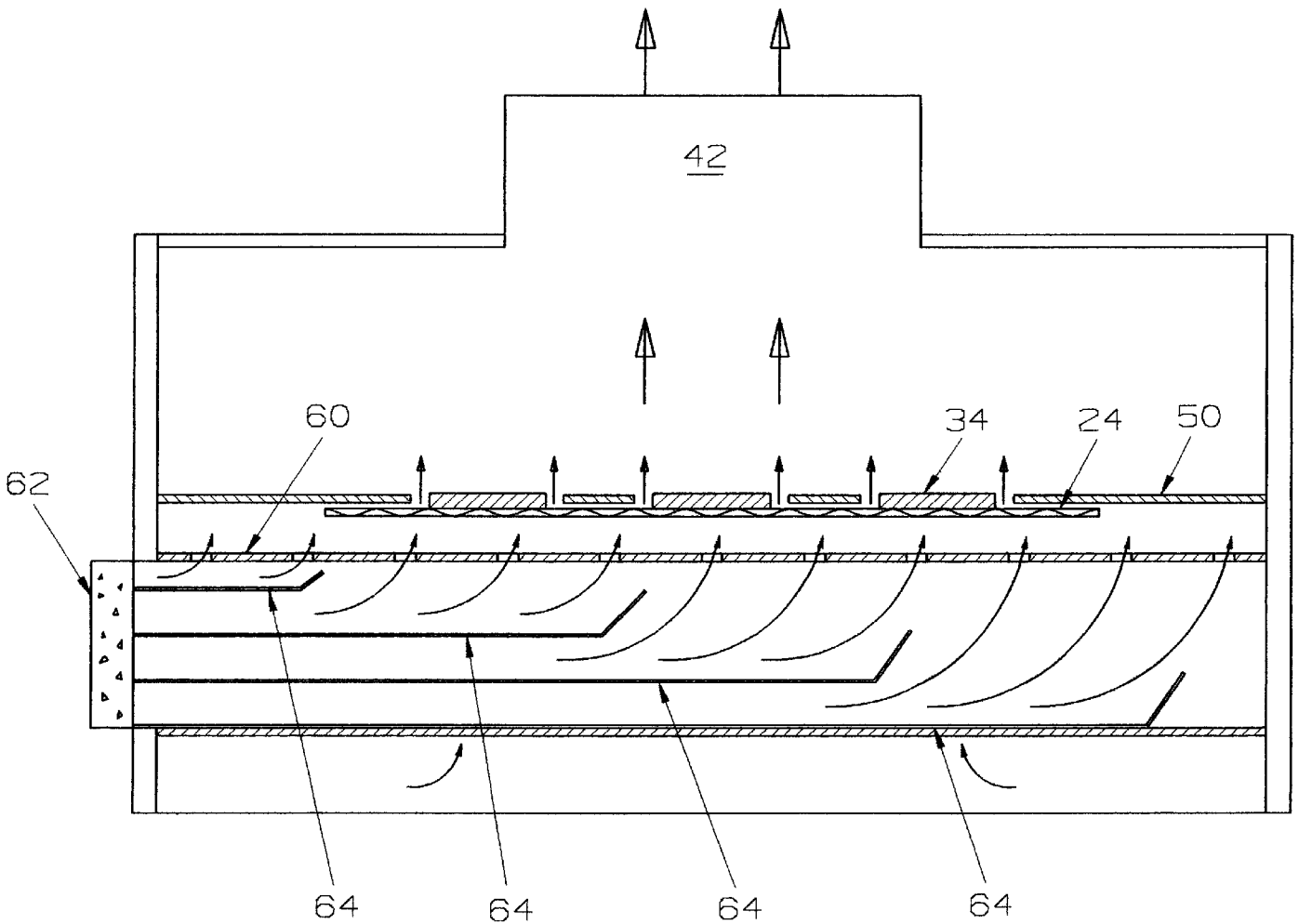
FIG. 3 is a cross-sectional view taken along view line 3—3 of FIG. 2.
Figure 3A:
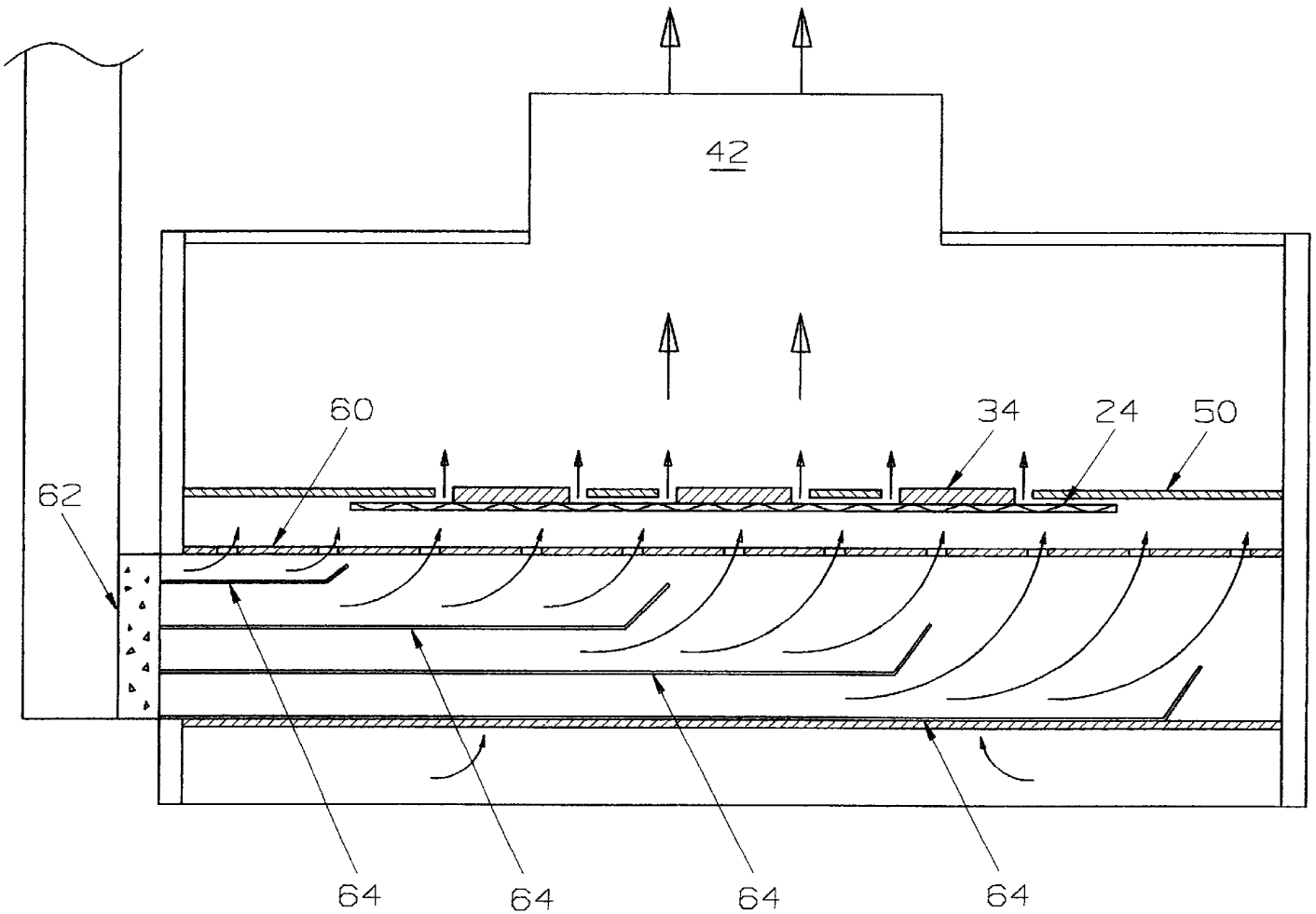

The source of the supplemental air may be from ambient air outside of the machine, and preferably through a filter as illustrated in FIG. 3. Alternatively, the supplemental air may be ducted from a remote and less dust-laden location, with or without a filter, as illustrated in FIG. 3A. In order to supply essentially equal amounts of supplemental air across the width of the machine, it has been found that the most efficient method is to provide flow vanes, such as vanes or baffles 64 illustrated in FIG. 3, which extend substantially across the width of the machine. Alternatively, plenums 60 may be of varying cross-section across the width, and/or be provided with ports of varying size across the width of the machine in order to provide substantially equal distribution of the supplemental air across the width of the machine.

The foregoing description of one preferred embodiment of the invention illustrates that, while the introduction of air immediately below the board line would be thought to seriously diminish the pressure differential across the board line, it has been unexpectedly discovered that this is not the case. Rather, it has been discovered that the differential can be maintained at a highly effective and low-power manner while solving the serious problem of dust entry into the machine and contamination of the printing plate. Of course, it will be apparent that many modifications and variations of the invention will become apparent to those skilled in the art. Accordingly, it is to be understood that the foregoing description of one preferred embodiment is intended to be illustrative rather than exhaustive of the principles of the invention, and that the scope of the invention is not intended to be limited other than as set forth in the following claims interpreted under the doctrine of equivalents.

What is claimed is:

1. A printing machine comprising at least one printing stage including a printing cylinder and an adjacent stage, and a transfer section between said first and second stages comprising:

(a) at least one exhaust blower for exhausting air from said printing machine;

(b) a horizontally extending plate for creating a pressure differential above and below said plate; and (c) duct means having one end extending into the area adjacent said printing cylinder for supplying supplemental air at a negative pressure adjacent said printing cylinder.

2. The printing machine of claim 1 including filter means for removing dust from said supplemental air before the air reaches the area adjacent said printing cylinder.

3. The printing machine of claim 1 wherein said duct includes a second end which extends into a location remote from said printing machine for drawing relatively dust-free supplemental air from said remote location.

4. The printing machine of claim 3 including filter means for reducing the dust content of said supplemental air.

5. The printing machine of claim 1 wherein said duct means extends across the width of said machine, and said duct means includes means for equalizing the flow of supplemental air across the width of said machine.

6. The printing machine of claim 5 wherein said means for equalizing the flow of supplemental air across the width of said machine are selected from the group of multiple vanes, varying cross-section of said duct and varying sizes of holes in said duct.

7. The printing machine of claim 6 wherein said means for equalizing the flow comprises multiple vanes in said duct, and each of said vanes extend across the width of said machine to a different extent.

8. A printing machine including at least one printing cylinder for printing on individual sheets of material passing through said printing machine comprising:

(a) at least one conveyor means;

(b) plate means extending horizontally through said machine;

(c) exhaust blower means for reducing the pressure on one side of said plate means to a negative pressure; and (d) duct means for introducing supplemental air at negative pressure to the other side of said plate means.

9. The printing machine of claim 8 including filter means for reducing the dust content of said supplemental air.

* * * * *